US008002351B2

(12) United States Patent
Golynsky

(10) Patent No.: US 8,002,351 B2
(45) Date of Patent: Aug. 23, 2011

(54) SUPPORT MEMBER

(75) Inventor: Arkady Golynsky, Allentown, PA (US)

(73) Assignee: Knoll, Inc., East Greenville, PA (US)

( * ) Notice: Subject to any disclaimer, the term of this patent is extended or adjusted under 35 U.S.C. 154(b) by 223 days.

(21) Appl. No.: 12/359,599

(22) Filed: Jan. 26, 2009

(65) Prior Publication Data

US 2010/0187884 A1 Jul. 29, 2010

(51) Int. Cl.
*A47C 1/024* (2006.01)

(52) U.S. Cl. ..... 297/301.1; 297/301.5; 297/309

(58) Field of Classification Search ..... 297/301.1, 297/301.5, 309, 302.5, 295, 285
See application file for complete search history.

(56) References Cited

U.S. PATENT DOCUMENTS

| | | | | |
|---|---|---|---|---|
| 3,416,839 | A * | 12/1968 | Flint | 297/396 |
| 4,328,943 | A | 5/1982 | Eldon, III | |
| 4,379,589 | A | 4/1983 | Marino | |
| 4,380,352 | A | 4/1983 | Diffrient | |
| 4,533,177 | A | 8/1985 | Latone | |
| 4,561,693 | A * | 12/1985 | Brownlie et al. | 297/300.5 |
| 4,869,552 | A * | 9/1989 | Tolleson et al. | 297/296 |
| 4,966,411 | A * | 10/1990 | Katagiri et al. | 297/300.7 |
| 5,154,438 | A | 10/1992 | Barclay | |
| 5,224,758 | A * | 7/1993 | Takamatsu et al. | 297/300.5 |
| 5,238,294 | A * | 8/1993 | Ishi et al. | 297/300.5 |
| 5,601,337 | A | 2/1997 | Choda et al. | |
| 5,683,139 | A | 11/1997 | Golynsky et al. | |
| 5,704,688 | A * | 1/1998 | Schrewe et al. | 297/285 |
| 5,909,923 | A | 6/1999 | DeKraker | |
| 5,944,382 | A * | 8/1999 | Ambasz | 297/300.1 |
| 6,116,687 | A * | 9/2000 | Vogtherr | 297/300.1 |
| 6,386,634 | B1 | 5/2002 | Stumpf et al. | |
| 6,669,292 | B2 | 12/2003 | Koepke et al. | |
| 6,767,066 | B1 | 7/2004 | Tornero | |
| 6,817,667 | B2 | 11/2004 | Pennington et al. | |
| 6,863,346 | B2 * | 3/2005 | Zund | 297/322 |
| 6,869,142 | B2 | 3/2005 | Heidmann et al. | |
| 6,910,736 | B2 | 6/2005 | White | |
| 6,913,315 | B2 | 7/2005 | Ball et al. | |

(Continued)

FOREIGN PATENT DOCUMENTS

| | | |
|---|---|---|
| GB | 678890 | 9/1952 |
| WO | WO 2008/041868 | 4/2008 |

OTHER PUBLICATIONS

PCT International Search Report and Written Opinion of the International Searching Authority, Jul. 12, 2010 PCT/US2010/021725.

*Primary Examiner* — Sarah B McPartlin
(74) *Attorney, Agent, or Firm* — Buchanan Ingersoll & Rooney PC

(57) ABSTRACT

A support member configured for attachment to a back assembly and a chair component is disclosed. One disclosed embodiment of the support member may be included in a chair that includes a base, a back assembly and the support member. The back assembly includes an extension attached to a back frame. The extension is attached to the base such that the back assembly is moveable relative to the base. The support member is attached to the extension and the base. The support member is more rigid than the extension. Preferably, the extension is composed of elastomeric material.

13 Claims, 4 Drawing Sheets

U.S. PATENT DOCUMENTS

| | | | |
|---|---|---|---|
| 7,273,253 | B2 | 9/2007 | Deimen et al. |
| 2004/0189073 | A1 | 9/2004 | Chadwick et al. |
| 2005/0052061 | A1 | 3/2005 | Deimen et al. |
| 2005/0093354 | A1 | 5/2005 | Ball et al. |
| 2006/0279126 | A1 | 12/2006 | Chu |
| 2007/0000111 | A1 | 1/2007 | Johnson et al. |

* cited by examiner

SUPPORT MEMBER

FIELD OF INVENTION

The present invention relates to chairs and supports for chair components.

BACKGROUND OF THE INVENTION

Chairs are often configured to have a back support that can be reclined. For instance, U.S. Pat. Nos. 4,328,943, 4,380,352, 4,533,177, 5,154,438, 5,601,337, 5,683,139, 5,909,923, 5,944,382, 6,386,634, 6,669,292, 6,767,066, 6,817,667, 6,869,142, 6,910,736, 6,913,315, and 7,273,253, U.S. Patent Application Publication Nos. US 2007/0000111, 2005/0093354, 2005/0052061 and 2004/0189073 and World Intellectual Property Publication No. WO 2008/041868 disclose chairs that include such a back support.

Recently, chairs have been designed to be made of recycled materials or materials capable of being recycled, such as frame structures composed of plastic. For instance, a back frame or seat frame may be composed of plastic and attached to a base composed of plastic or metal. It is often desirable to have a reclinable back in such chairs. The reclinable back often includes a back frame that is attached to a seat or base that can pivot along one or more pivot points defined in the base or seat frame.

Often, fabricators and designers of office chairs and other chairs reject designs that utilize a reclinable back frame construction that does not incorporate multiple pivot points or multiple moveable rigid linkages. Such reclinable back frames may require one or more components to deform to permit the back frame to recline. However, such deforming components can provide uneven support to a user such that the back may bend or twist upon recline. Such bending and twisting of the back can reduce the effective life of the chair and also provide an uncomfortable ride to a user. Moreover, such deformable components may provide a "hard stop" upon reclining such that the ride of the chair during recline is not smooth. Many users find such "hard stops" uncomfortable or undesirable. At least because of the aforementioned problems, back designs that do not utilize pivots defined in a base or seat frame to recline a chair back are often not even conceived, let alone considered.

A support member is needed for utilization in chair designs that help support a chair back during recline of the chair back while also providing the stability necessary to evenly support a user reclining such a chair back. Preferably, such a support is configured so that the support member improves the ride of the chair back during recline of the chair back without detracting from the aesthetic effect of the chair.

SUMMARY OF THE INVENTION

A support member is disclosed that is sized and configured for attachment to a back assembly and an elastomeric chair component. The support member includes a plate portion, a first projection and a second projection. The plate portion has a front side configured for attachment to an elastomeric chair component, a rear side opposite the front side, a first side between the front side and rear side and a second side opposite the first side that is between the front side and rear side. The first projection has a first end and a second end. The first end is attached to the rear side of the plate portion and the second end is configured for attachment to the back assembly.

The second projection also has a first end attached to the rear side of the plate portion and a second end configured for attachment to the back assembly.

Preferably, the elastomeric chair component is a chair base, an elastomeric connector, a control mechanism, or a seat frame component. The support member is also preferably more rigid than a portion of the back assembly.

The support member may have one or more recesses or ribs formed in the plate portion. The ribs or recesses may also be formed in other portions of the support member. It should be appreciated such recesses or ribs may be configured to provide additional strength or rigidity to the support member.

The first and second projections may be integrally joined with the plate portion such that the plate portion and first and second projections form a unitary structure. Preferably, that support member is composed of metal, such as stainless steel or aluminum.

Embodiments of the support member can include a flange that extends from the first projection and a flange that extends from the second projection. The flanges are sized and configured for engagement with a portion of a back assembly and may be configured to fit within slots or recesses formed in a portion of the back assembly.

A chair is also disclosed. The chair can include a base and a back assembly that includes a back frame attached to an extension. The extension is attached to the base such that the back frame is moveable relative to the base. The chair also includes a support member attached to the extension and the base. The support member is more rigid than the extension.

Certain embodiments of the chair may also include a base that has an elastomeric connector attached to the support member. The elastomeric connector deforms when the back frame is reclined. The support member may include a plate portion attached to the elastomeric connector and at least one projection extending from the plate portion that is attached to the extension. Preferably, the one or more projections include a flange configured for attachment to the extension.

Other details, objects, and advantages of the invention will become apparent as the following description of certain present preferred embodiments thereof proceeds.

BRIEF DESCRIPTION OF THE DRAWINGS

Present preferred embodiments of the support member and chair are shown in the accompanying drawings and certain present preferred methods of practicing the same are also illustrated therein, in which.

DETAILED DESCRIPTION OF PRESENT PREFERRED EMBODIMENTS

Figure 1:
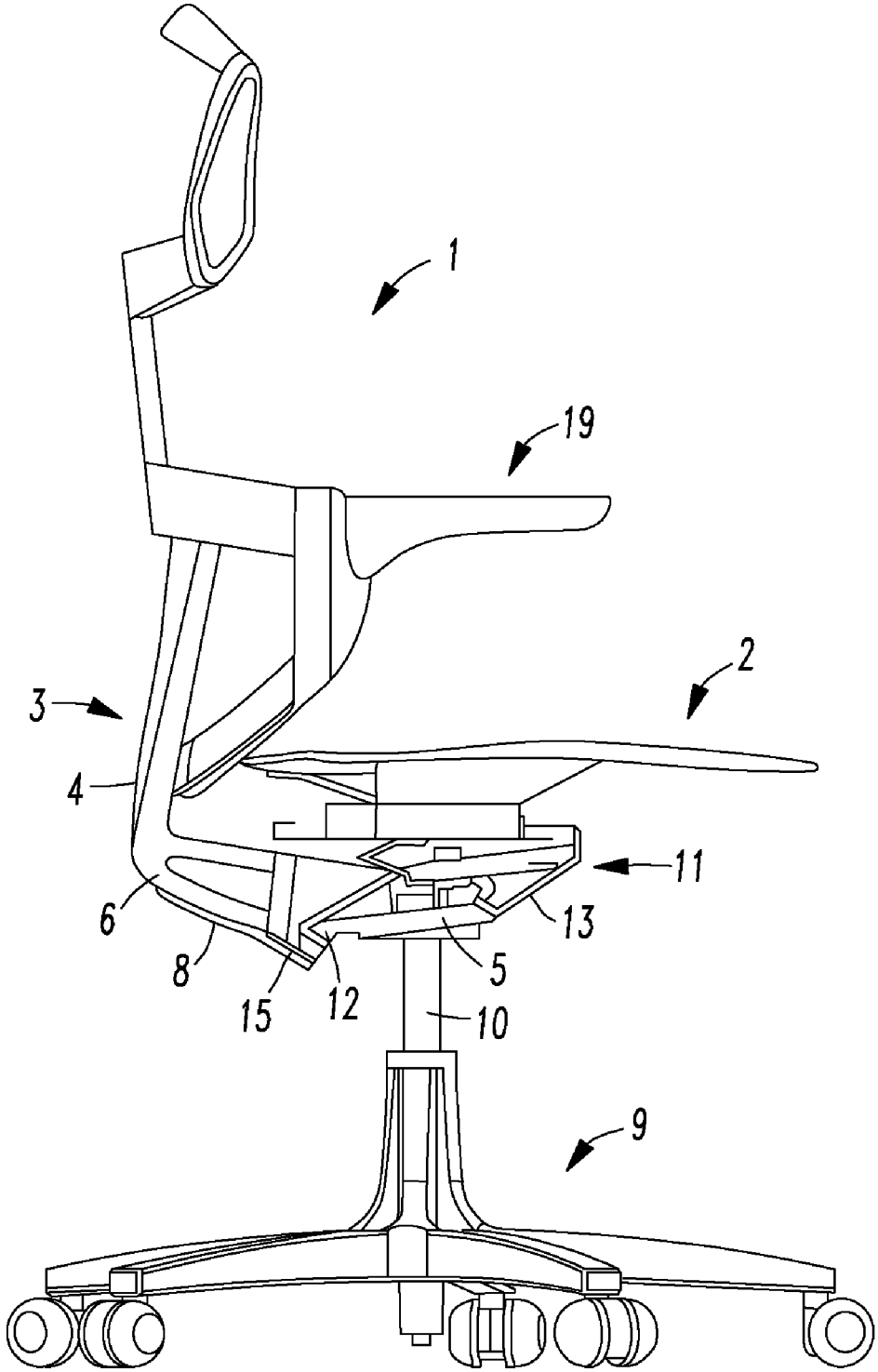
FIG. 1 is a perspective side view of a first present preferred embodiment of a chair having a present preferred support member.
Figure 2:
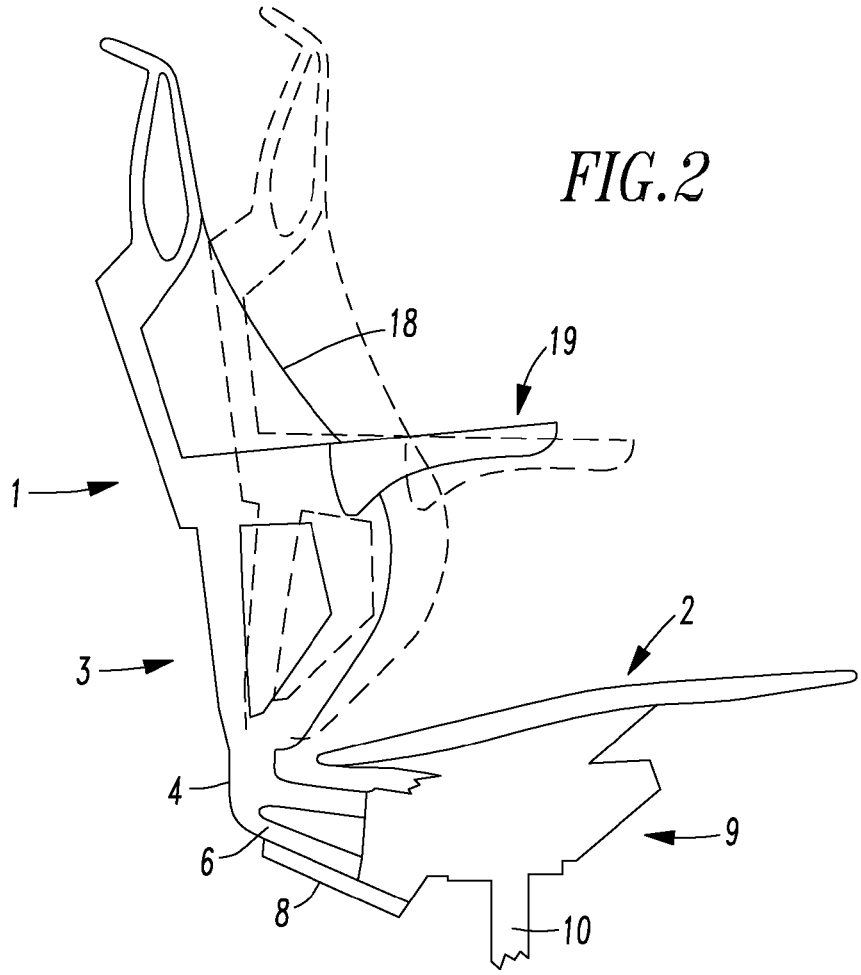
FIG. 2 is a fragmentary side view of the first present preferred embodiment showing the back of the chair in a reclined position in solid line and the back of the chair in an upright position in dotted line.
Figure 3:
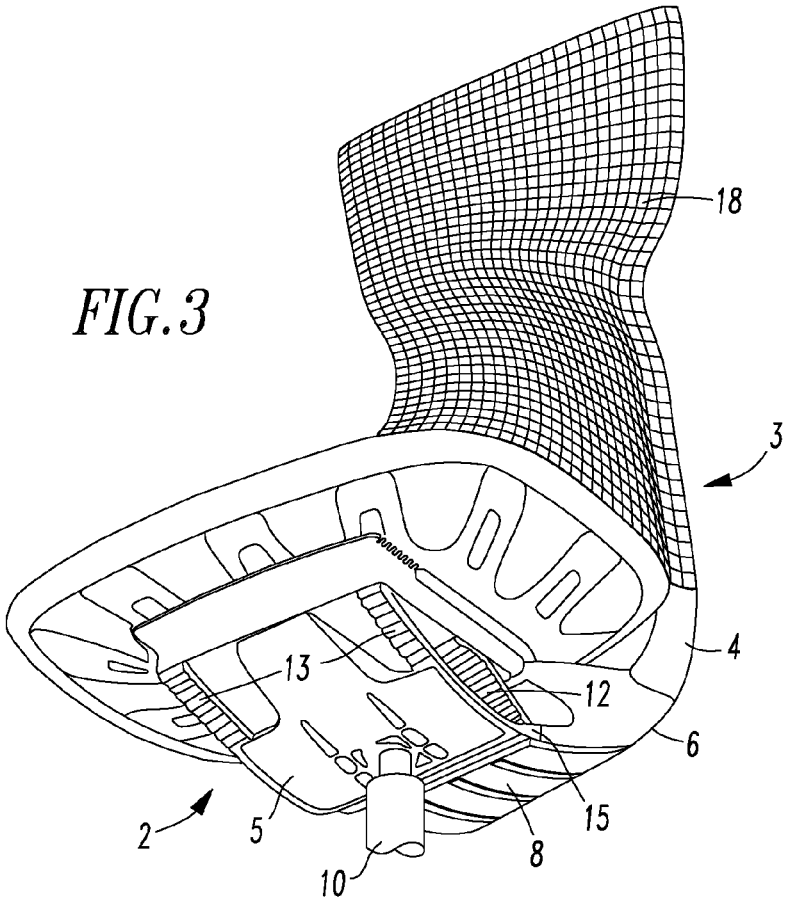
FIG. 3 is a fragmentary bottom view of the first present preferred embodiment.

A first present preferred embodiment of a chair 1 is illustrated in FIGS. 1-3. The chair 1 includes a back assembly 3 and a seat assembly 2. The back assembly 3 includes a back frame 4 that is attached to an extension 6 and a back skin 18. The extension 6 may be integral with the back frame 4 or be fastened or otherwise connected to a portion of the back frame 4. The back frame 4 and extension 6 may be composed of an elastomeric material, plastic, metal or other material. The back skin 18 is attached to the back frame 4 and is configured to engage and support the back of a seated user. The back skin 18 may be composed of various materials such as mesh, fabric or elastomeric material.

The chair 1 also includes a base 9. The base is attached to the seat assembly 2 and the back assembly 3. The base 9 includes a pedestal 10 attached to a control mechanism 11. The pedestal 10 may include a gas cylinder or other column configured for height adjustment of the chair 1. The control mechanism 11 includes a front set of deformable straps 13 and a rear set of deformable straps 12. The straps 12 and 13 are attached to a transom 5 that is preferably composed of metal or plastic. The transom 5 is attached to the pedestal 10. An elastomeric connector 15 extends from the transom 5 toward the extension 6. The elastomeric connector 15 may preferably be an elastomeric web, elastomeric member or a flexible strap that is positioned along at least a portion of the width of the transom 5. Preferably, the elastomeric connector 15 is composed of a thermoplastic elastomer such as Hytrel® made by E. I. du Pont de Nemours and Company or its affiliates or a material composed of polyester. The elastomeric connector 15 may be integrally molded with the rear straps 12 or attached to the control mechanism. In some embodiments, the connector 15 may be attached to the extension 6 or engage the extension 6. Bolts or other fasteners may connect the extension 6 to the elastomeric connector 15.

A support member 8 is attached to the extension 6 of the back frame 4 and the elastomeric connector 15 of the base 9. The support member 8 is preferably composed of metal and is preferably more rigid than the extension 6 or elastomeric connector 15.

Arm assemblies 19 may be attached to the back frame 4. In alternative embodiments, the arm assemblies may be attached to the base or a seat assembly. Of course, other embodiments of the chair may not include arm assemblies.

As may be appreciated from FIG. 2, the back assembly 3 is configured to move relative to the base 9 such that the back frame 4 can move from an upright position, which is illustrated in dotted line, to a reclined position, which is illustrated in solid line. Preferably, deformation of the connector 15, the extension 6, the front straps 13 and/or the back straps 12 permit a user to recline the back 3. The straps 12 and 13 can also be configured to deform upon recline of the back to lift the seat when a user reclines the back. It is contemplated that one or more pivot points may also be provided in the base 9 or seat assembly 2 about which the back assembly 3 may rotate.

The support member 8 is attached to the elastomeric connector 15 of the base 9 and to the extension 6 of the back frame 4. The support member 8 is preferably positioned below the extension 6 and the elastomeric connector 15 and is sized and configured such that it is not readily apparent to a user standing behind the back assembly 3 of the chair 1.

A present preferred embodiment of a support member is illustrated in FIGS. 4-8. The support member 28 has a plate portion 30 attached to a first projection 31 and a second projection 32. The proximate end of each projection is attached to the plate portion 30. Preferably, the projections 31 and 32 and plate portion 30 are portions of a unitary structure that is formed from a plate of metal.

The support member 28 has a bottom surface 51 and a top surface 52. The plate portion 30 of the support member 28 has a front side 54, a rear side 53, a first side 56 between the front 54 and rear 53 sides and a second side 57 between the front 54 and rear 53 sides.

The plate portion 30 has a series of holes 40 sized and configured for fasteners such as bolts or screws. The fasteners may be inserted through the holes to attach the plate portion 30 to an elastomeric connector, a chair base or other chair component. The plate portion 30 also includes a plurality of recesses 34, 36 and 38. The recesses may be configured such that they define ribs that project from the bottom surface 51 of the support member 28, as may be seen in FIG. 7. Preferably, the recesses include tapered sidewalls 61 that define the recessed portions of the plate portion 30, as may best be appreciated from FIG. 8.

The first projection 31 includes a flange 41 adjacent the distal end of the first projection 31. The flange 41 extends upward and is configured for attachment to a portion of the back assembly 3, such as the extension 6. The second projection 32 also includes a flange 42 adjacent the distal end of the second projection 32. The flange 42 extends upward and is configured for attachment to a portion of a back assembly, such as the extension 6.

Figure 4:
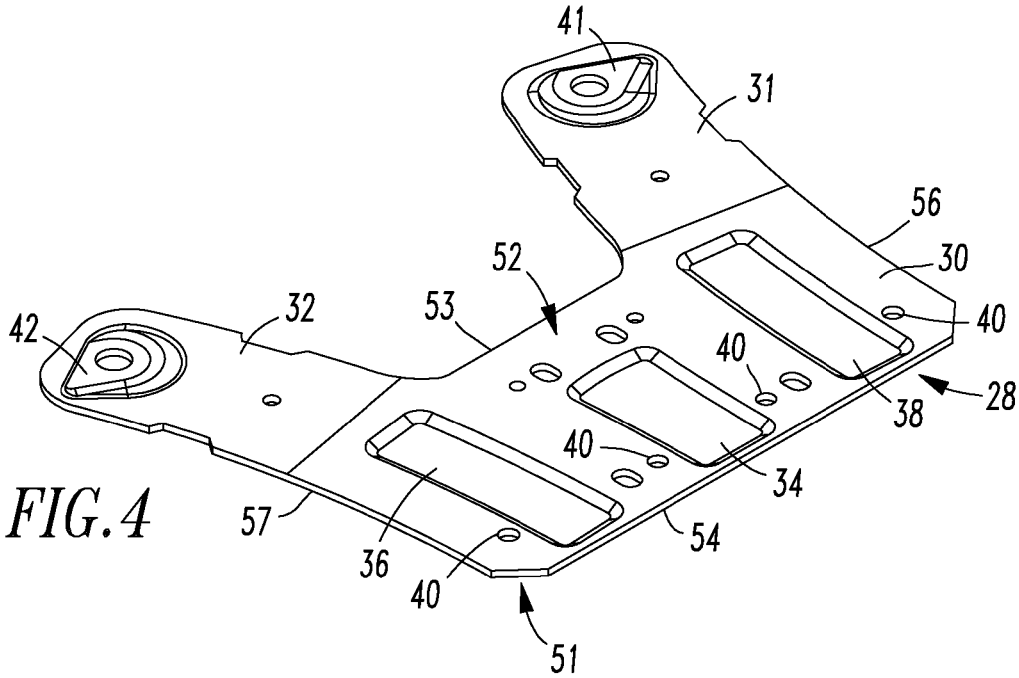
FIG. 4 is a perspective view of a first present preferred embodiment of a support member.
Figure 5:
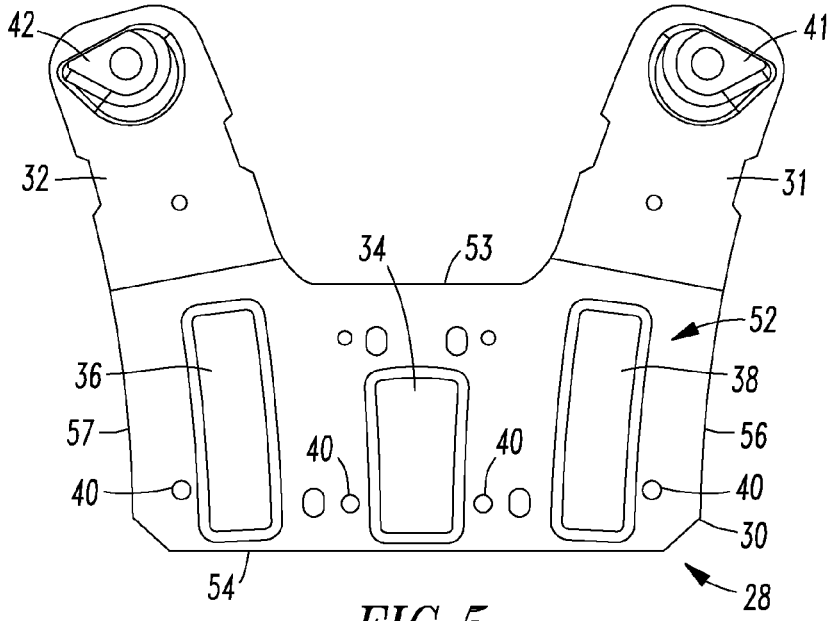
FIG. 5 is a top view of the first present preferred embodiment of the support member.

Preferably, the distal end of the first projection 31 extends behind and beyond the first side 56 of the plate portion 30, as may be best appreciated from FIGS. 4 and 5. The distal end of the second projection 32 preferably extends behind and beyond the second side 57 of the plate portion 30.

Figure 6:
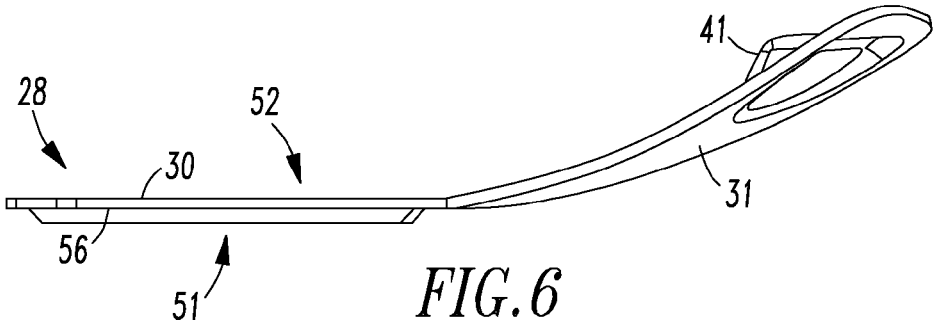
FIG. 6 is a side view of the first present preferred embodiment of the support member.
Figure 7:
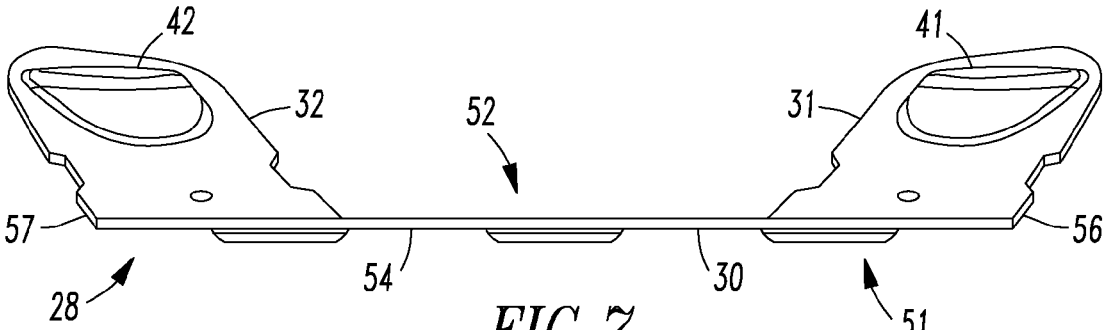
FIG. 7 is a front view of the first present preferred embodiment of the support member.
Figure 8:
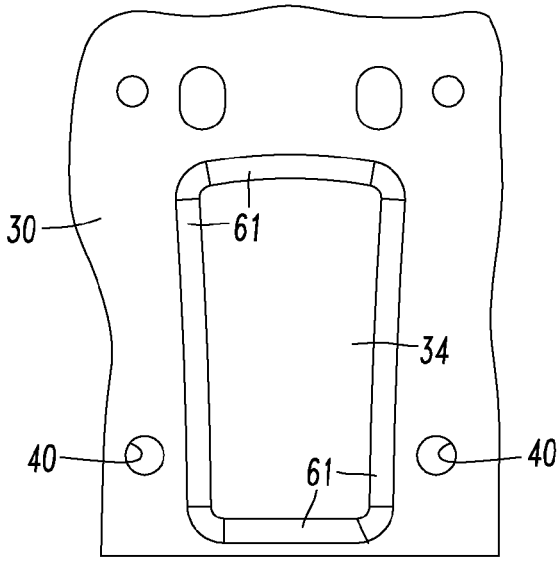
FIG. 8 is a fragmentary top view of the first present preferred embodiment of the support member illustrating a central recess located in the plate portion of the first present preferred embodiment of the support member.

As may be appreciated from FIGS. 6 and 7, the support member 28 is configured such that the plate portion 30 is flat for attachment to the base of a chair or other chair component. The projections 31 and 32 are preferably curved such that the projections extend upward and along a curved portion of a back assembly, such as back extension 6 shown in FIGS. 1-3 or other back assembly 3 portion. Flanges 41 and 42 may be configured to fit within recesses or slots (not shown) formed in a portion of the back assembly 3 for attachment to the back assembly 3. Fasteners or other connection mechanisms such as welding or over molding may also be used to attach the projections 31 and 32 to the back frame.

Of course, variations of the present preferred embodiments discussed above may be made. For example, embodiments of the support member can include no ribs or recesses. As another example, the back extension may be integrally molded with the back frame or may be fastened to the back frame by connectors, welding, over molding or other connection mechanisms. As yet another example, embodiments of the chair can include a back assembly that includes a lumbar support attached to the back assembly, seat assembly or chair base.

While certain present preferred embodiments of the support member and chair including such a support member have been discussed and illustrated, and certain present preferred methods of making and using the same have also been discussed and illustrated, it is to be distinctly understood that the invention is not limited thereto but may be otherwise variously embodied and practiced within the scope of the following claims.

What is claimed is:

1. A chair comprising:

a base, the base supporting a seat, the base being below the seat;

a back assembly comprised of an extension attached to a back frame, the extension attached to the base such that the back frame is moveable relative to the base;

a support member attached to the extension and the base, the support member being positioned below the seat and under the extension, the support member being more rigid than the extension, the support member providing support to the extension when the back frame is reclined; and the support member comprising a plate portion, a first projection attached to the plate portion and a second projection attached to the plate portion, the plate portion having a front side, a rear side, a first side and a second side opposite the first side, the first projection having a first end and a second end that is integral with the plate portion, the first end of the first projection extending behind and beyond the first side of the plate portion, and the second projection having a first end and a second end that is integral with the plate portion, the first end of the second projection extending behind and beyond the second side of the plate portion.

2. The chair of claim 1 wherein the support member is composed of metal and the extension is composed of elastomeric material.

3. The chair of claim 1 wherein the base comprises an elastomeric connector; and wherein the extension is attached to the elastomeric connector of the base such that the back frame is moveable relative to the base; and wherein the support member is also connected to the elastomeric connector of the base, the support member being more rigid than the extension; and wherein the elastomeric connector deforms when the back assembly is reclined.

4. The chair of claim 3 wherein the plate portion is attached to the elastomeric connector and the first projection is attached to the extension and the second projection is attached to the extension.

5. The chair of claim 1 wherein the plate portion is attached to the base.

6. The chair of claim 1 wherein the support member has at least one recess formed in the support member.

7. The chair of claim 1 wherein the support member has at least one rib formed in the support member.

8. The chair of claim 1 wherein the first projection having an upwardly extending flange that fits within an opening formed in the extension and engages with a portion of the extension to connect the support member to the extension.

9. The chair of claim 1 wherein the first end of the first projection being narrower than the second end of the first projection and the first end of the second projection being narrower than the second end of the second projection.

10. The chair of claim 1 wherein the back frame is integral with the extension.

11. The chair of claim 1 wherein the base comprises an elastomeric connector and the support member has a top surface and a bottom surface, the top surface configured to engage the extension and the elastomeric connector.

12. The chair of claim 1 wherein the first end of the first projection is comprised of a flange that extends from the first projection and is sized and configured for engagement with a portion of the extension and the first end of the second projection is comprised of a flange that extends from the second projection and is sized and configured for engagement with the extension.

13. The chair of claim 1 wherein the first projection and the second projection are attached to the plate portion such that the first projection, second projection and plate portion are a unitary structure.

* * * * *